US009581322B2

(12) United States Patent
Lin

(10) Patent No.: US 9,581,322 B2
(45) Date of Patent: Feb. 28, 2017

(54) HEAT-SINK FOR HIGH BAY LED DEVICE, HIGH BAY LED DEVICE AND METHODS OF USE THEREOF

(71) Applicant: Aeonovalite Technologies, Inc., New Taipei (TW)

(72) Inventor: Chhiu-Tsu Lin, Sycamore, IL (US)

(73) Assignee: Aeonovalite Technologies, Inc., New Taipei (TW)

( * ) Notice: Subject to any disclaimer, the term of this patent is extended or adjusted under 35 U.S.C. 154(b) by 63 days.

(21) Appl. No.: 14/503,267

(22) Filed: Sep. 30, 2014

(65) Prior Publication Data

US 2016/0091192 A1 Mar. 31, 2016

(51) Int. Cl.

| | |
|---|---|
| ***F21V 29/77*** | (2015.01) |
| ***F28F 13/18*** | (2006.01) |
| ***F21V 29/74*** | (2015.01) |
| *F21Y 101/00* | (2016.01) |

(52) U.S. Cl.

CPC ..... *F21V 29/773* (2015.01); *F21V 29/74* (2015.01); *F28F 13/18* (2013.01); *F21Y 2101/00* (2013.01)

(58) Field of Classification Search

CPC .... F21V 29/2212; F21V 29/77; F21V 29/773; F21V 29/777; F21V 29/004; F21V 29/503; F21V 29/74; F21V 29/75; F28F 13/18; H01L 23/367; H01L 23/3672; H01L 33/642

See application file for complete search history.

(56) References Cited

U.S. PATENT DOCUMENTS

| | | | |
|---|---|---|---|
| D194,787 | S | 3/1963 | Chadwick |
| 3,239,003 | A | 3/1966 | Boudette |
| 6,633,484 | B1 | 10/2003 | Lee |
| 6,845,010 | B2 | 1/2005 | Lee |
| 6,851,467 | B1 | 2/2005 | Bamford |
| D544,127 | S | 6/2007 | Posey |
| D576,964 | S | 9/2008 | Shaner |
| D591,894 | S | 5/2009 | Flank |
| D603,810 | S | 11/2009 | Yang |
| D619,551 | S | 7/2010 | Lin |

(Continued)

FOREIGN PATENT DOCUMENTS

| | | |
|---|---|---|
| CN | 201434365 | 3/2010 |
| CN | 202149462 | 2/2012 |

(Continued)

OTHER PUBLICATIONS

EarthLED.com, product description "Par38 LED Light Bulbs", found at www.earthled.com/collections/par38-led-light-bulbs-par-38-led, 2 pages, printed on Sep. 29, 2014.

(Continued)

*Primary Examiner* — Anh Mai
*Assistant Examiner* — Steven Horikoshi
(74) *Attorney, Agent, or Firm* — Evan Law Group LLC

(57) ABSTRACT

A heat sink comprises a base, primary fins on and vertically extending from the base, and a fin-free region on the base. The primary fins each have a first arm, a second arm, which meets the first arm to form a primary fin bottom, and a stem, which extends away from the primary fin bottom. The heat sink is particularly useful in a high bay LED device, with a molecular fan coating on the heat sink.

18 Claims, 11 Drawing Sheets

(56) References Cited

U.S. PATENT DOCUMENTS

| | | | | |
|---|---|---|---|---|
| D627,911 | S | 11/2010 | Mo | |
| 7,828,464 | B2 | 11/2010 | Wang | |
| D634,279 | S | 3/2011 | Chua | |
| 7,931,969 | B2 | 4/2011 | Lin | |
| D640,819 | S | 6/2011 | Pan | |
| 8,087,456 | B2 | 1/2012 | Wei | |
| 8,192,049 | B2 | 6/2012 | Hyun | |
| D664,291 | S | 7/2012 | Blincoe | |
| 8,403,533 | B1 | 3/2013 | Paulsel | |
| 8,403,541 | B1 | 3/2013 | Rashidi | |
| 8,408,759 | B1 | 4/2013 | Rashidi | |
| 8,434,907 | B2 | 5/2013 | Kong | |
| 8,523,409 | B1 | 9/2013 | Drake | |
| D691,315 | S | 10/2013 | Samson | |
| D692,175 | S | 10/2013 | Rashidi | |
| 8,545,933 | B2 | 10/2013 | Lin | |
| D695,941 | S | 12/2013 | Rashidi | |
| D696,448 | S | 12/2013 | Huh | |
| D707,382 | S | 6/2014 | Ni | |
| 8,876,333 | B1 | 11/2014 | Rashidi | |
| D721,845 | S | 1/2015 | Lui | |
| D726,131 | S | 4/2015 | Zhai | |
| D730,302 | S | 5/2015 | Shum | |
| D762,181 | S | 7/2016 | Lin | |
| 2007/0166551 | A1* | 7/2007 | Lin | H01L 23/373 428/423.1 |
| 2008/0080190 | A1 | 4/2008 | Walczak | |
| 2009/0147520 | A1 | 6/2009 | Liu | |
| 2010/0020553 | A1 | 1/2010 | Teng | |
| 2010/0026158 | A1 | 2/2010 | Wu | |
| 2010/0046168 | A1* | 2/2010 | Liaw | F21K 9/13 361/704 |
| 2010/0149818 | A1 | 6/2010 | Ruffin | |
| 2010/0296272 | A1 | 11/2010 | Roos | |
| 2011/0002124 | A1 | 1/2011 | Chang | |
| 2011/0198979 | A1* | 8/2011 | Shum | F21K 9/1375 313/46 |
| 2012/0182744 | A1 | 7/2012 | Santiago | |
| 2013/0294077 | A1* | 11/2013 | Gabrius | F21S 8/026 362/241 |
| 2014/0035461 | A1* | 2/2014 | McDonald | F21K 9/00 315/113 |
| 2014/0268750 | A1* | 9/2014 | Lui | F21S 8/061 362/235 |
| 2015/0117017 | A1 | 4/2015 | Johnston | |
| 2015/0184837 | A1* | 7/2015 | Zhang | F21S 8/00 362/294 |

FOREIGN PATENT DOCUMENTS

| | | | |
|---|---|---|---|
| CN | 202691972 | 1/2013 | |
| CN | 203656869 | 6/2014 | |
| CN | 203703903 | 7/2014 | |
| TW | M423207 | 2/2012 | |
| TW | D149242 | 9/2012 | |
| TW | D149380 | 9/2012 | |
| TW | D156055 | 9/2013 | |
| TW | 201522856 | 6/2015 | |
| TW | 104300627 | 4/2016 | |
| TW | 201612462 | 4/2016 | |
| WO | WO 2014015656 A1 * | 1/2014 | F21S 8/00 |

OTHER PUBLICATIONS

EarthLED.com, product description "MR16 LED Light Bulbs", found at www.earthled.com/collections/mr16-led-light-bulbs, 2 pages, printed on Sep. 29, 2014.

Definition of "Heat Sink" printed from Wikipedia, the free encyclopedia on Sep. 23, 2014 found at http://en.wikipedia.org/wiki/Heat_sink#cite_note-Bider-30, pp. 1-18.

Qpedia, vol. 3, issue 8, Sep. 2009.

LED Professional Review, issue 13, May/Jun. 2009.

Taiwan Search Report dated Jun. 23, 2015 for Taiwan application No. 104300627 with translation.

U.S. Appl. No. 29/508,907, mailed Feb. 22, 2016.

U.S. Appl. No. 29/508,907, mailed Apr. 21, 2016.

* cited by examiner

HEAT-SINK FOR HIGH BAY LED DEVICE, HIGH BAY LED DEVICE AND METHODS OF USE THEREOF

BACKGROUND

A heat sink is a device for the passive dissipation of heat. Heat sinks are typically used with electronic device where the heat dissipation of the basic device is insufficient to maintain the temperature in a desired range. Light emitting diodes (LED), especially those used for indoor and outdoor lighting require a heat sink for optimal operation.

A heat sink can have a significant impact on the operation of an LED. Changes in the junction temperature of an LED can affect the lifetime, and the energy efficiency, of the LED, with lower temperatures extending the lifetime and increasing the energy efficiency. Furthermore, the equilibrium brightness of an LED will also be greater as the junction temperature is decreased, due to the increased efficiency of the LED.

A typical heat sink for an LED, or other electronic device, is designed to maximize surface area in order to maximize the transfer of heat from the electronic device to the surrounding air. Heat is drawn out of the electronic device by conduction into the heat sink. Then the heat sink primarily dissipates heat into the surrounding air by convection. The design of a typical heat sink therefore uses highly heat conductive materials for the body of the heat sink, and maximizes surface area to maximize contact with the surrounding air. Furthermore, the shape of a heat sink will typically include vertically aligned pins, fins or channels, which will allow the warmed air in contact with the heat sink to rise and flow away from the electronic device. Although a heat sink will also dissipate heat by radiation, this factor is often neglected in the design because it is believed that dissipation of heat by radiation at normal temperatures (0 to 100° C.) is generally small in comparison to dissipation of heat by convection.

A molecular fan is a coating which may be applied to a surface, to increase substrate surface emissivity and thus to enhance "active" heat dissipation by radiation. Such coatings are described in U.S. Pat. Nos. 7,931,969 (Lin, Apr. 26, 2011) and 8,545,933 (Lin, Oct. 1, 2013). The molecular fan takes advantage of the high emissivity in the infra-red of discrete molecules (as opposed to extended solids) which result from transitions between different vibrational states. The molecular fan will include nanoparticles to increase surface area, and functionalized nanomaterials to provide the discrete molecules on the surface of the coating that will radiate infra-red light as they transition between different vibrational states. An emulsion that hardens upon curing is also included in a molecular fan coating material, to adhere the nanoparticles and functionalized nanomaterials on the surface of the device or heat sink. The molecular fan coating provides good surface hardness, provides resistance to fingerprints, inhibits corrosion and is easy to clean.

Applying a molecular fan onto the surface of a typical heat sink will increase heat dissipation. However, a typical heat sink is designed to maximize heat dissipation by convection rather than radiation, and includes surfaces which do not radiate away from the device or heat sink, allowing the radiation to be reabsorbed. Therefore, application of a molecular fan onto such surfaces of a typical heat sink does not significantly improve heat dissipation from those surfaces.

SUMMARY

In a first aspect, the present invention includes a heat sink, comprising a base, primary fins on and vertically extending from the base, and a fin-free region on the base. The primary fins each have a first arm, a second arm which meets the first arm to form a primary fin bottom, and a stem which extends away from the primary fin bottom.

In a second aspect, the present invention includes a compound heat sink, comprising a base, primary fins on and vertically extending from the base, and a plurality of fin-free regions on the base. The primary fins each have a first arm, a second arm which meets the first arm to form a primary fin bottom, and a stem which extends away from the primary fin bottom. At least one of the primary fins has an opening angle of 22.5° to 45°, and the primary fins are disposed around the fin-free regions, with the stem of each primary fin oriented toward one of the fin-free regions.

In a third aspect, the present invention includes a high bay LED device, comprising an LED, a heat sink thermally coupled to the LED, a lens surrounding the LED, and a reflector surrounding the lens. The fin-free region of the base is located directly above the LED.

In a fourth aspect, the present invention includes a high bay LED device, comprising a plurality LEDs, a heat sink thermally coupled to the LEDs, a lens surrounding the LEDs, and a reflector surrounding the lens. The fin-free regions of the base are located directly above each LED.

In a fifth aspect, the present invention includes method of producing light, comprising applying an electric current to the high bay LED device.

DEFINITIONS

"High bay LED device" means a device which generates light with an LED for wide angle illumination. Such device may operate on AC or DC current.

"Heat sink" means a device for the passive dissipation of heat from an electronic device, such as an LED.

Directions and orientations used in the present application to describe different parts of heat sinks and high bay LED devices and their relative orientation, are with respects to the base of the heat sink orientation towards the ground, with the fins rising vertically up from the base, and the LED being below the base, projecting light downward. In actual use, the heat sink and high bay LED devices may be oriented in any direction.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 10:
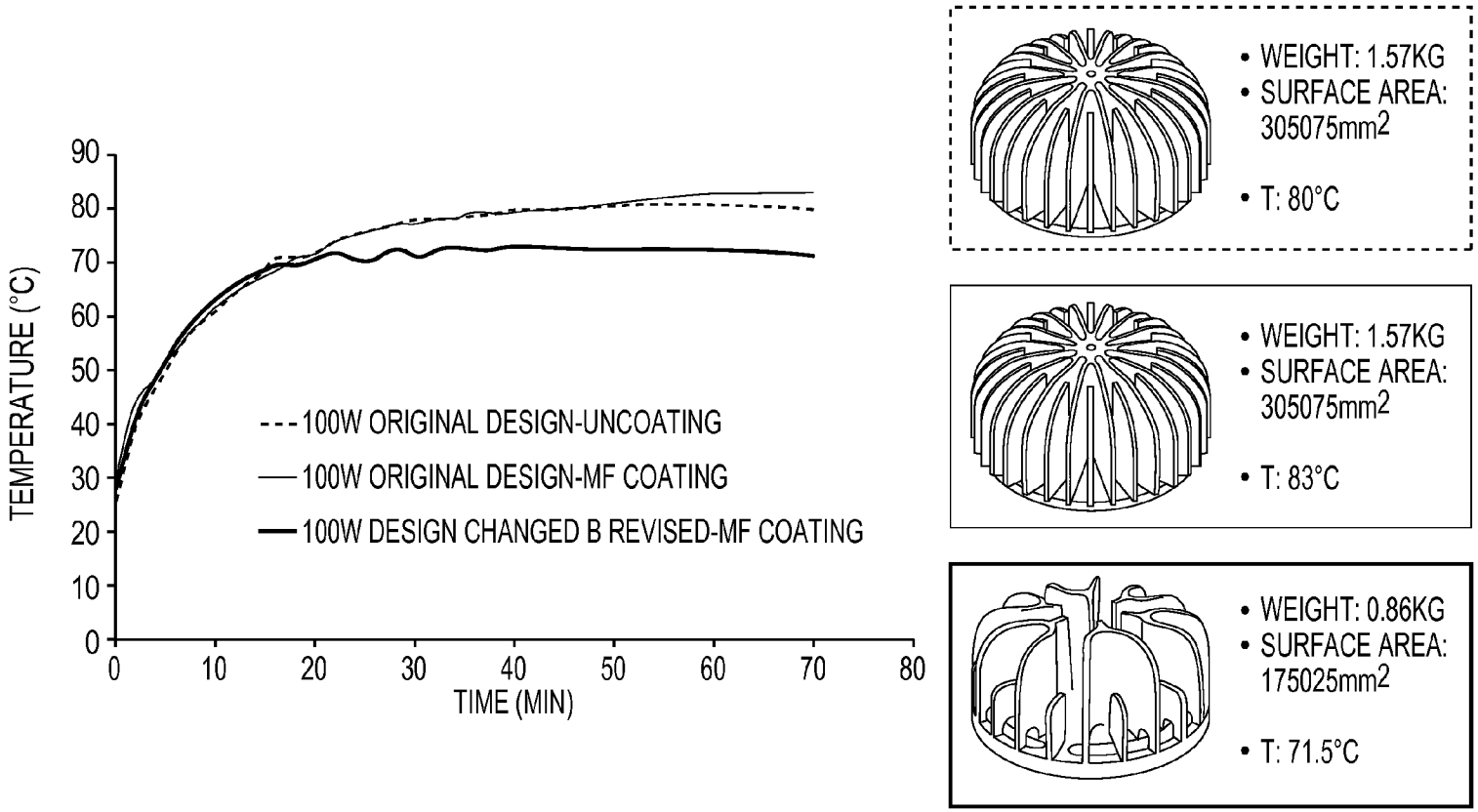
FIG. 10-13 show the experimental results of the junction temperatures (T) of various high bay LED devices having a heat sink of the present application or a comparative heat sink, coated or uncoated with a molecular fan. The designs and other features of the heat sinks used in these examples are shown in the right side of the figures.
Figure 12:
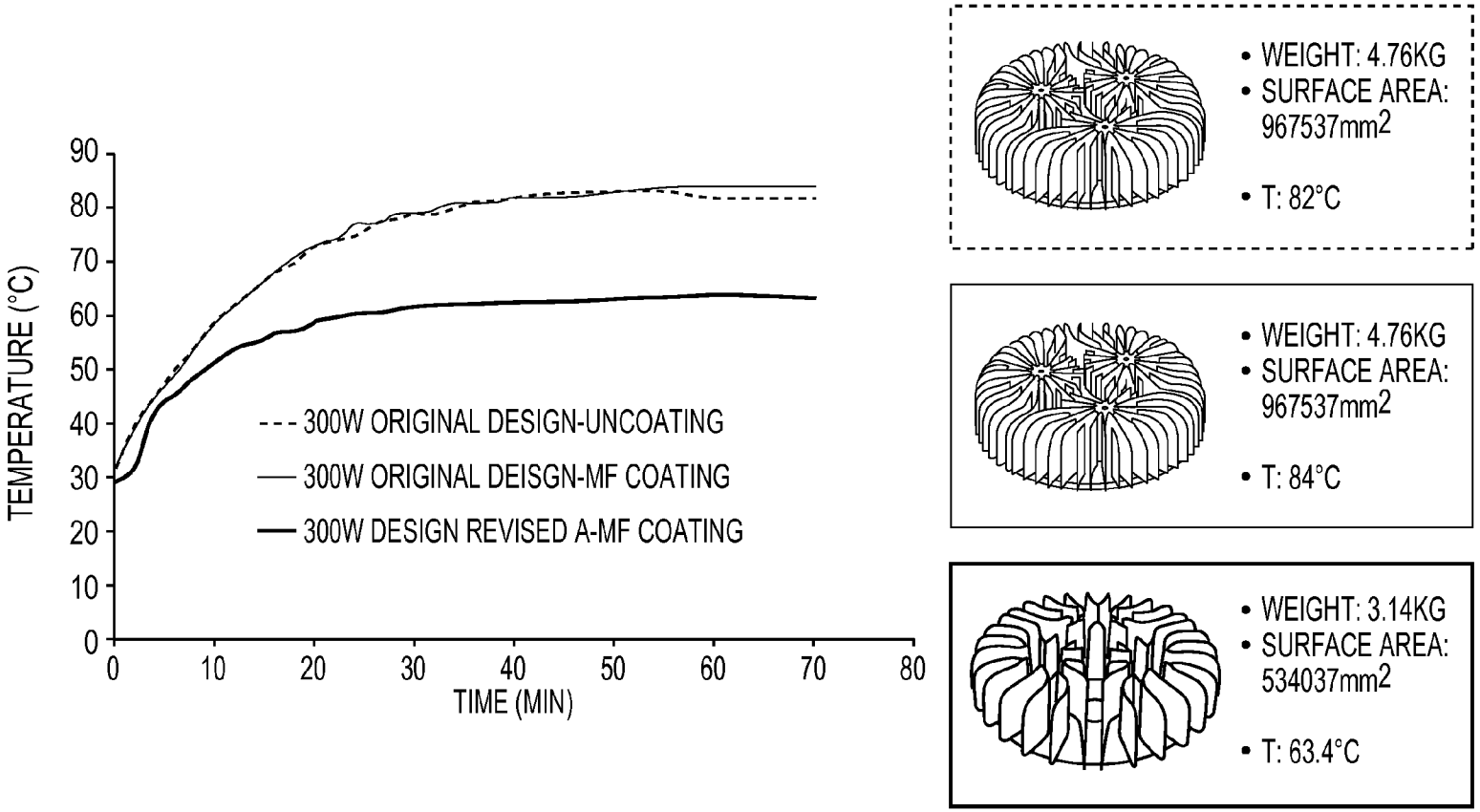

The present invention make use of the discovery of heat sink shapes that take best advantage of heat dissipation by radiation when a molecular fan coating is present, while still maintaining significant heat dissipation by convection, and conduction of heat away from an electronic device. The heat sink shapes take advantage of the high emissivity provided by a molecular fan coated on the surface of the heat sink. When thermally coupled to an LED in a high bay LED device, a dramatic increase in energy efficiency is realized, along with an increase in device lifetime. Furthermore, the equilibrium brightness of the device is increased, and the weight is substantially reduced. For example, the device weight was reduced from 1.57 kg to 0.86 kg for a 100 W LED device as shown in FIG. 10, and the device weight was reduced from 4.76 kg to 3.14 kg for a 300 W LED device as shown in FIG. 12. The heat sink of the present application may not only be adapted for use in high bay LED devices, but also other LED devices such as PAR 38 and MR 16, as well as other electronic devices such as CPU, and graphics processing units (GPU).

The heat sink includes (i) a base, (ii) a fin-free region of the base which is directly above the LED; and (iii) a plurality of primary fins, each primary fin extending vertically from the base and including a first arm and a second arm, and a stem which meets the arms at the base of the fin, where the first and second arms also meet. Optionally, the heat sink may also include 1, 2 or 3 of the following features: (iii) a plurality of secondary fins, each secondary fin have a sheet shape and extending vertically from the base; (iv) a convection hole in the base, and extending below a primary fin; and (v) a convection hole in a primary fin and/or a secondary fin.

Figure 1:
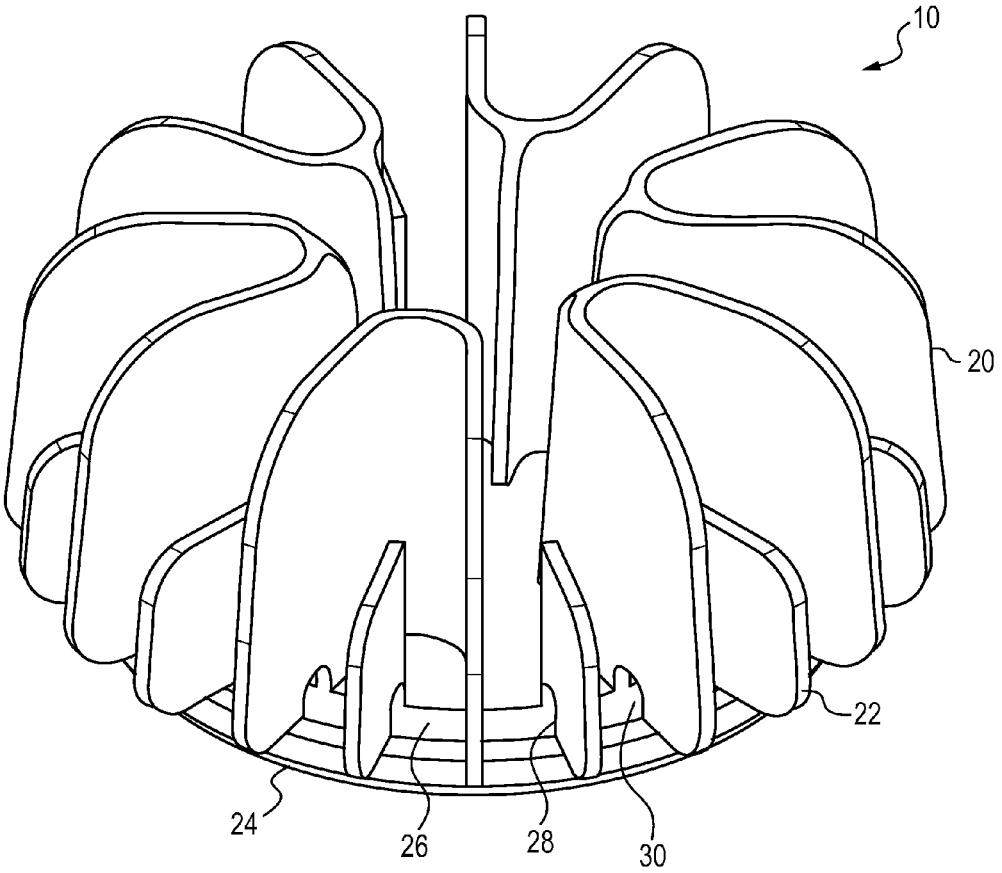
FIG. 1 illustrates a perspective view a first heat sink.

FIG. 1 illustrates a perspective view a first heat sink, 10. The heat sink includes six primary fins, 20, 12 secondary fins, 22, a base, 24, four base convection holes. 26, a secondary fin convection hole, 28, in each secondary fin, and two primary fin convection holes, 30, in each primary fin. In this illustration, as well as many of the other illustrations, numbers has been applied to only one instance of each feature in the figures for clarity.

The heat sink, including the base, the primary fins, and optional secondary fins, are made from a heat conductive material, preferably a metal, for example copper, aluminum, and alloys thereof. The parts may be made from the same or different materials. Preferably aluminum alloys are used, because of the light weight and low cost. The base, primary fins and optional secondary fins, may be made separately and then bond, bolted or welded together. Alternative, the entire structure may be cast or welded as a single, monolithic piece.

Figure 2:
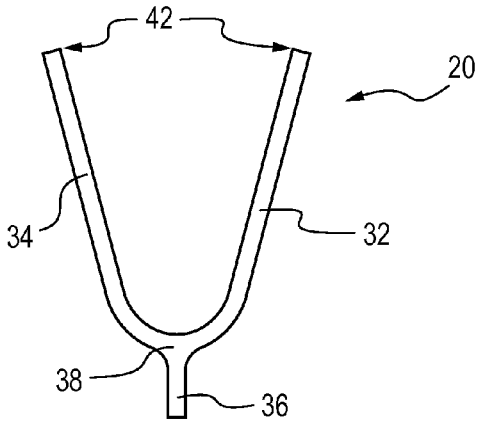
FIG. 2 illustrates a primary fin for a heat sink.

FIG. 2 illustrates a primary fin for a heat sink, 20. The primary fin includes a first arm, 32, and a second arm, 34, which meet at the primary fin bottom, 38, preferably forming a parabolic shape. The primary fin also includes a stem, 36, which extends away from the primary fin bottom. Both the first arm and the second arm have an open end, 42. As illustrated in this figure, the primary first and second arms of the primary fin are mirror images, and have the same length, but this need not be the case; as will be shown in FIGS. 6-9 of compound heat sinks, the shape and length of each arm of the primary fin may be quite different. Preferably, the primary fin has exactly two arms, but additional arms may be present.

Figure 3:
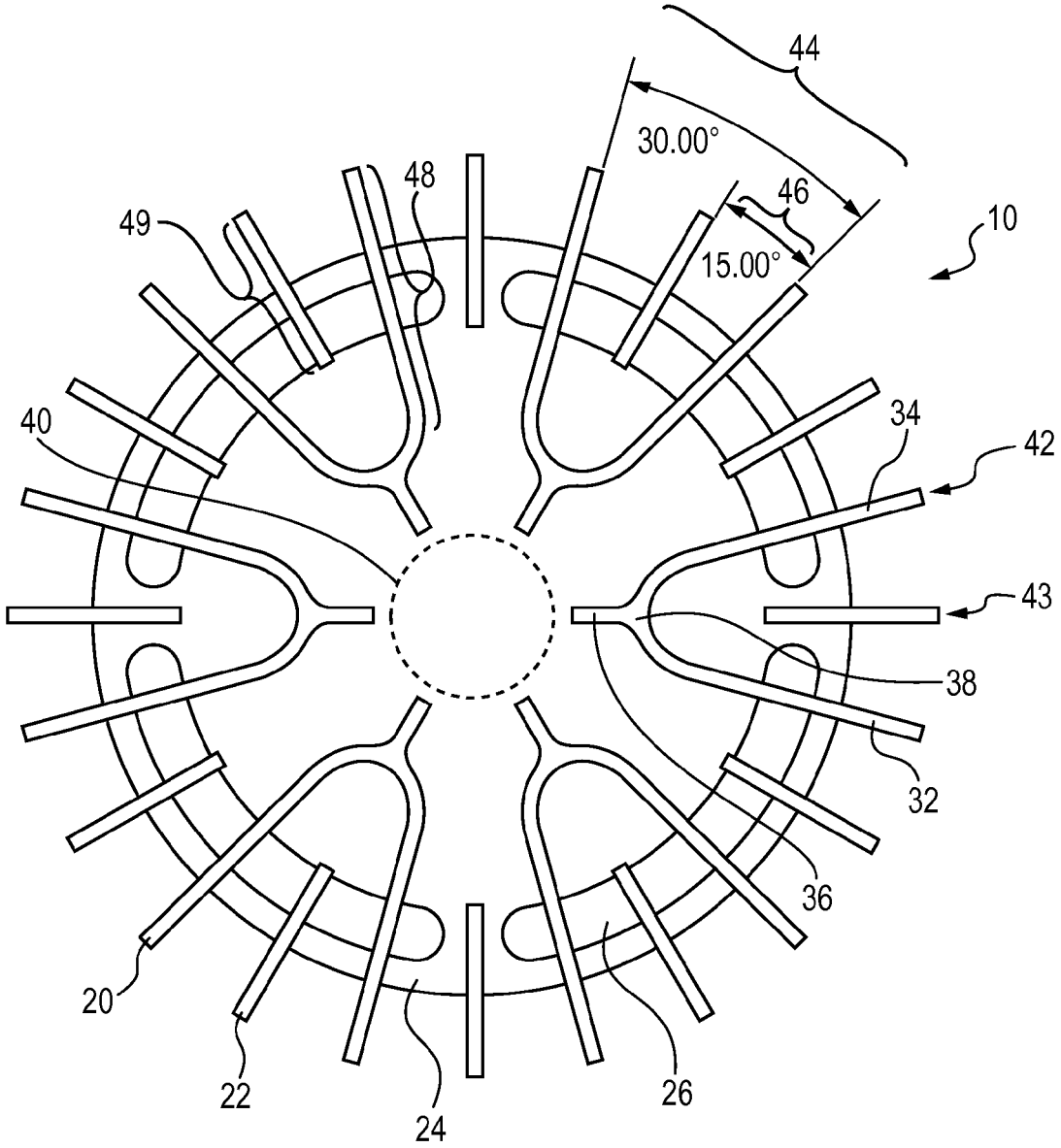
FIG. 3 illustrates a top view of the first heat sink.

FIG. 3 illustrates a top view of the first heat sink, 10. In addition to those features shown in FIG. 1 and FIG. 2, this figure also shows a fin-free region, 40, of the base (delimited by a dotted line). The secondary fin has an external end, 43. The length of a secondary fin, 49, is the distance along the length of the secondary fin between ends, while the length of an arm, 48, of a primary fin is the distance along the length of an arm extending from the primary fin bottom to an open end of the arm. The opening angle, 44, of a primary fin is the angle formed by two lines originating in the center of the fin-free region of the base, and ending at the open end of the first and second arms. The secondary fin angle, 46, in the angle formed by two lines originating in the center of the fin-free region of the base, one ending at the open end of the closest of the first or second arm of a primary fin, and the other ending at the external end of the secondary fin. Although not numbered in the figures, the height of a fin is the largest distance the fin extends vertically from the base. In this heat sink, the primary fins and secondary fins extend beyond the base. Alternatively, the primary fins and/or secondary fins may be formed so that they do not extend beyond the base.

In one aspect, the heat sink preferably includes 4, 5, 6, 7 or 8 primary fins, and which preferably have the same length first and second arms in each primary fin, and same length first and second arms in all of the primary fins. Preferably, each fin is disposed radially about the fin-free region, with the stem of each primary fin oriented towards the fin-free region. The opening angle of one or more of the primary fins is preferably at least 22.5°, at least 25°, or at least 30°, including 22.5° to 40°. The arms of the primary fins are preferably not parallel, thus reducing absorption of radiation which was emitted from a fin. In FIGS. 1 and 3, the primary fins all have the same opening angle, but in other aspects this is not required. In one aspect, the heat sink preferably has 2-fold, 3-fold, 4-folds, 5-fold or 6-fold rotational symmetry. The height of each primary fin is preferably 20 to 200 mm, including 30, 40, 50, 60, 70, 80, 90 and 100 mm.

The optional secondary fin preferably is placed between arms of the primary fin, and/or between primary fins. Preferably, the secondary fin has a length less than the length of the first or second arm of the primary fin, including ¾ the length, ½ the length, ⅓ the length or ¼ the length, of the first or second arm of the primary fin. The height of the secondary fin may the same as, or less than, the height of the primary fin, including ¾ the height, ½ the height, ⅓ the height, or ¼ the height, of the primary fin, such as ¼ to ¾ of the height of the primary fin. For example, the height of each secondary fin may be 10, 15, 20, 25, 30, 35, 40, 45 and 50 mm. The secondary fin may be place radially about the fin-free zone. The secondary fin angle may be the same as, or less than, the primary fin angle, including ¾, ½, ⅓, or ¼ the primary fin angle, such as ¼ to ¾ of the primary fin angle. For example, the secondary fin angle may be 11.25°, 12.5°, 15°, 20°, 22.5°, 25°, or 30°; the secondary fin angles may be the same or different within a heat sink.

Preferably, the heat sink base includes 1 or more base convection holes, for example 1, 2, 3, 4, 5, 6, 7, 8, 9 or 10 base convection holes. The base convection holes may be any shape, but preferably are present below a primary fin, and are preferably absent from the fin-free region. Preferably each primary fin and/or secondary fin also includes 1 or more fin convection holes, more preferably 1 secondary fin convection hole and 2 primary fin convection holes (with one in each arm of the primary fin). Preferably, each fin convection hole is contiguous with a base convection hole.

Figure 14:
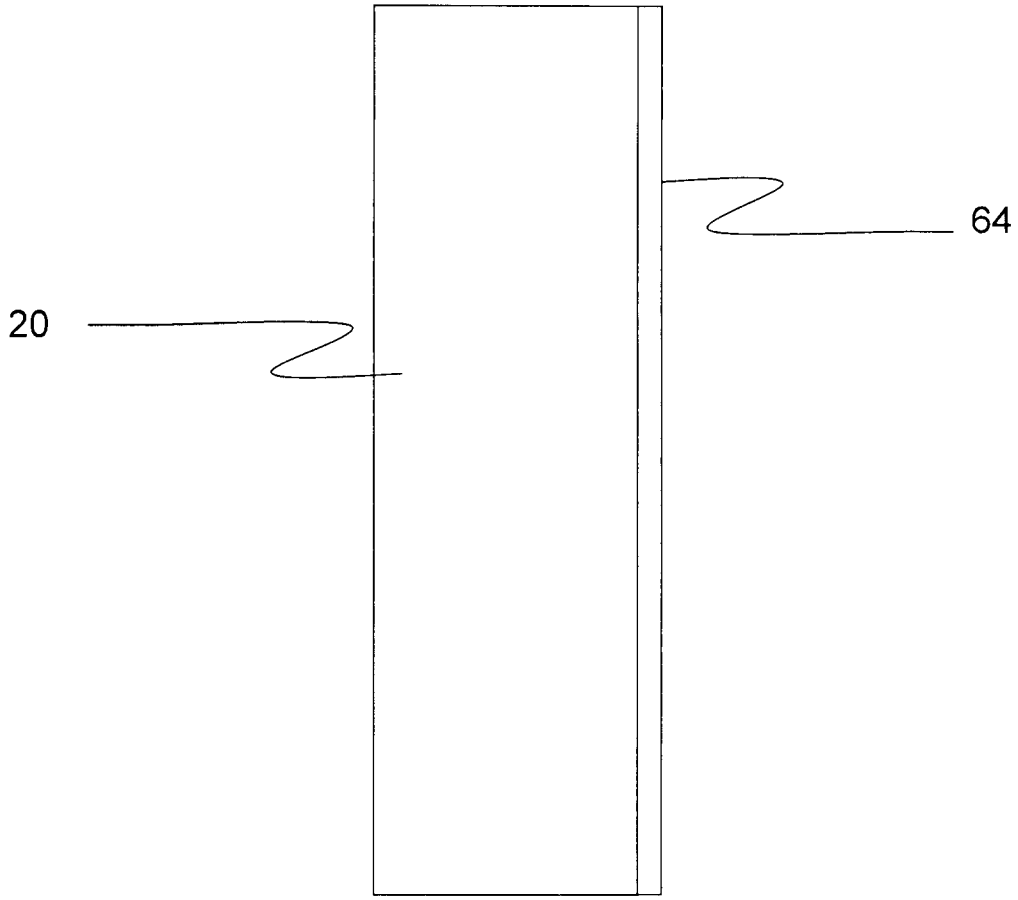
FIG. 14 illustrates a partial view of a molecular fan coating on a heat sink.

Preferably, the heat sink has a molecular fan coating. FIG. 14 illustrates a partial view of a molecular fan coating 64 on a heat sink. Such coatings are described in U.S. Pat. Nos. 7,931,969 (Lin, Apr. 26, 2011) and 8,545,933 (Lin, Oct.1, 2013). The molecular fan will include nanoparticles to increase surface area, and functionalized nanomaterials to provide the discrete molecules on the surface of the coating that will radiate infra-red light as they transition between different vibrational states. An emulsion that hardens upon curing is also included in a molecular fan coating material, to adhere the nanoparticles and functionalized nanomaterials on the surface of the device or heat sink. Other components may be added to the coating, to improve other properties, such as corrosion resistance, adhesion, resistance to fingerprints, ease of cleaning and color. Other types of coating are possible, such as a black coating, to enhance emissivity, but they are not as effective as a molecular fan coating. The molecular fan coating is an "active" heat dissipation technology, which takes up almost no space and does not require power.

Figure 4:
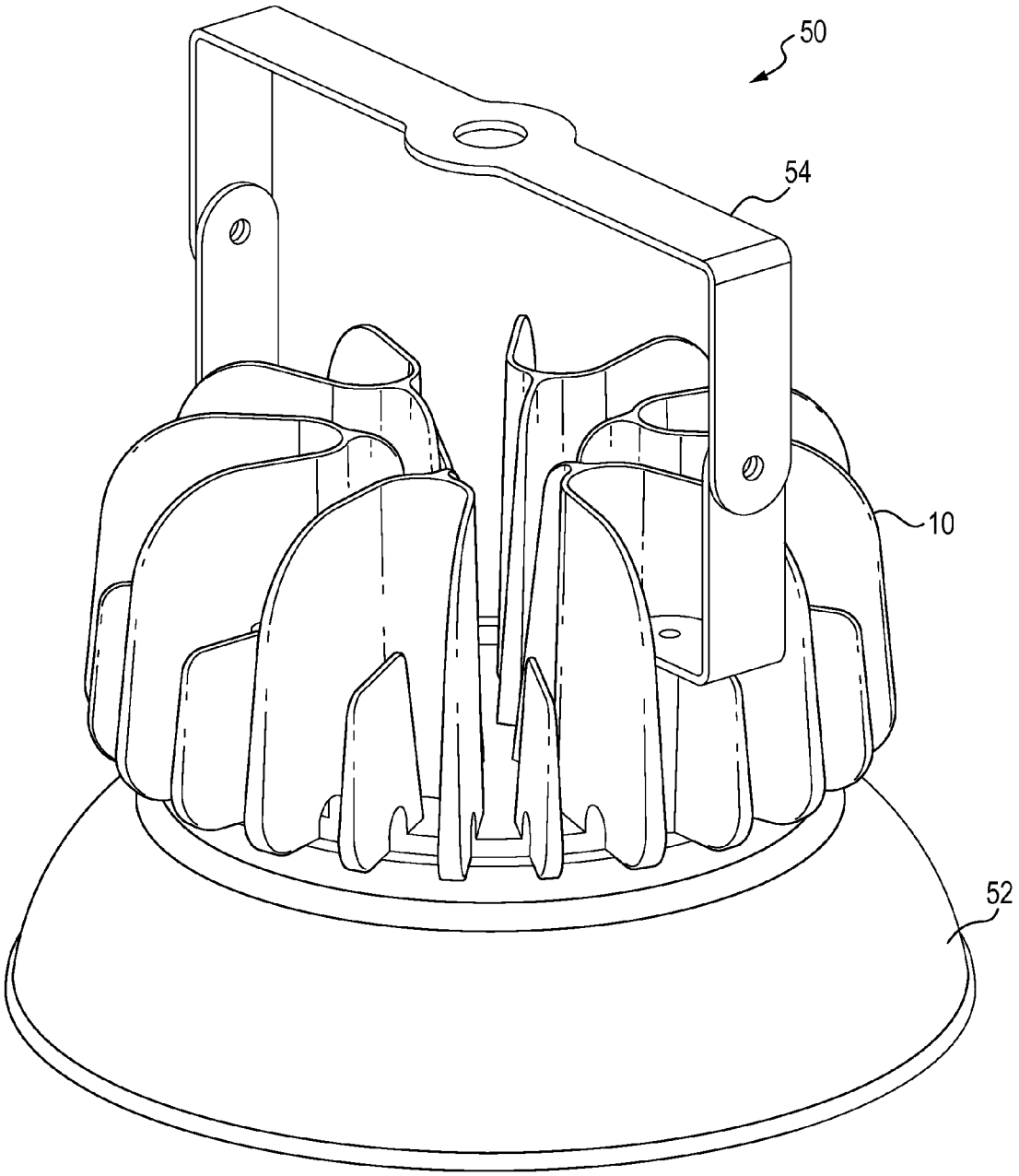
FIG. 4 illustrates a perspective view of a high bay LED device.

FIG. 4 illustrates a perspective view of a high bay LED device, 50. The high bay LED device includes a heat sink, 10, a reflector, 52, and an optional bracket, 54, for ease of mounting the high bay LED device. The high bay LED device illustrated may be hung from a ceiling to provide light for an office or a factory, or for the hydroponic growing of agricultural products, including flowers, fruits and herbs.

Figure 5:
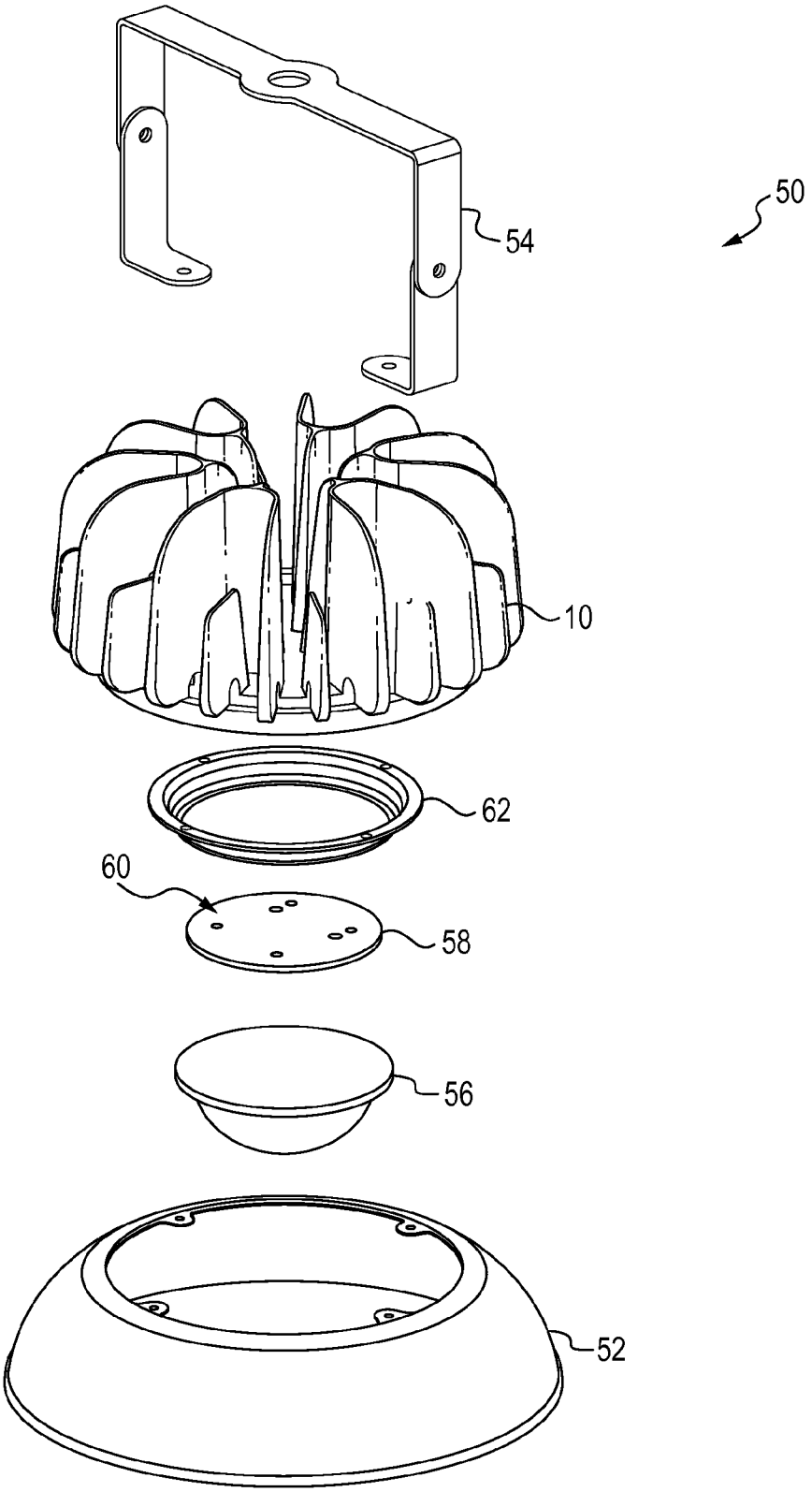
FIG. 5 illustrates an exploded view of the high bay LED device of FIG. 4.

FIG. 5 illustrates an exploded view of the high bay LED device of FIG. 4. In addition to those features shown in FIG. 4, the high bay LED device also includes a lens surrounding the LED, 56, for spreading the light emitted by the LED over a wide angle, an LED thermally coupled to the heat sink, 58, the LED having a conventional heat-conductive paste, 60, to improve transfer of heat and reduce thermal ohmic effects to the heat sink, and an optional connector, 62, for connecting heat sink to the other features. The lens surrounds the LED, and the reflector surrounds the lens. If multiple LEDs are present in the device, the lens surrounds all the LEDs.

All components illustrated are conventional, commercially available or available by customer request, except for the heat sink. LEDs are available in a variety of wattages, including 50 W, 70 W or 100 W. The heat sink is placed within the high bay LED device so that the fin-free region is directly above the LED. The lens and the reflector aid in distributing the light of the LED over a wide angle, below the high bay LED device.

Figure 6:
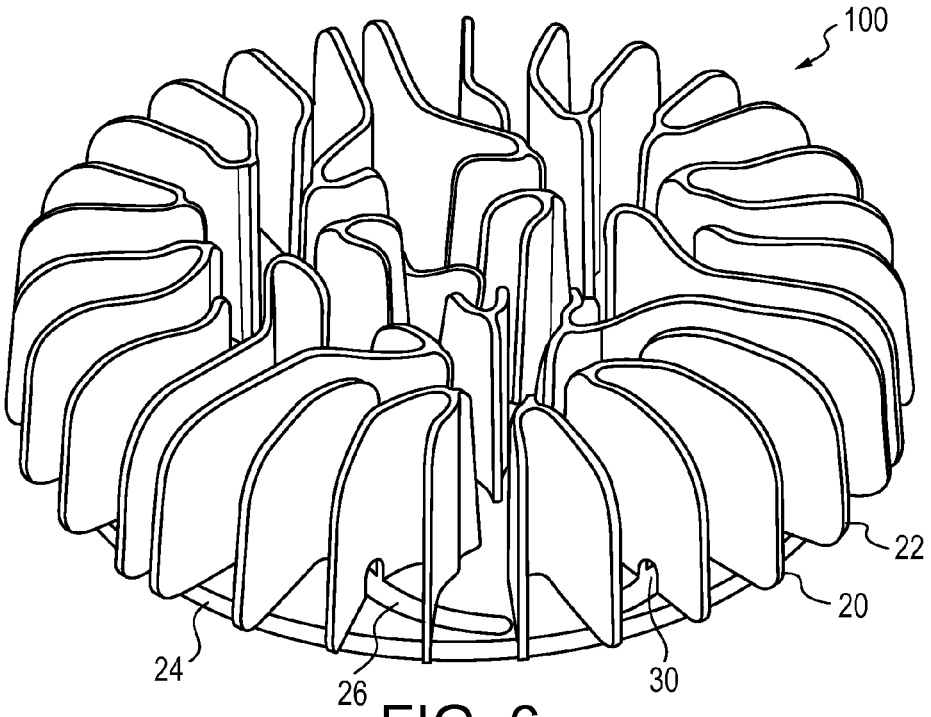
FIG. 6 illustrates a perspective view of a second heat sink.

FIG. 6 illustrates a perspective view of a second heat sink, 100. This is a compound heat sink, intended for use with a plurality of LEDs (in this instance, 3 LEDs), used in a single high bay LED device. The compound heat sink includes 18 primary fins, 20, 9 secondary fins, 22, a base, 24, 7 base convection holes, 26, and primary fin convection holes, 30, in many of the primary fins.

Figure 7:
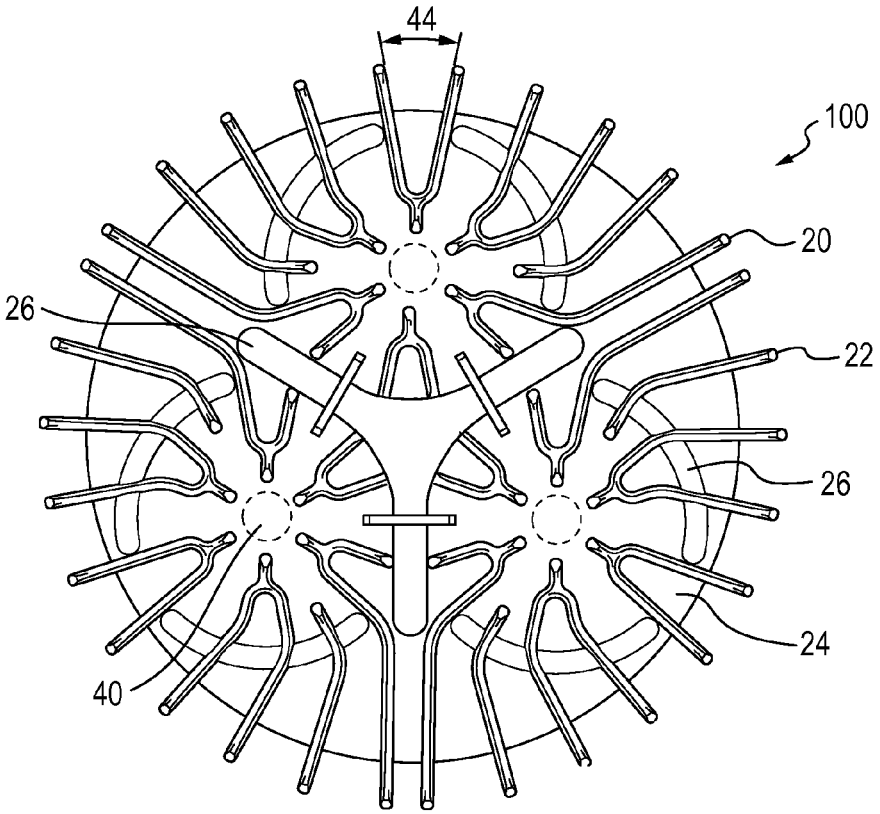
FIG. 7 illustrates a top view of the second heat sink.

FIG. 7 illustrates a top view of the second heat sink. In addition to those features illustrated in FIG. 6, this figure also shows fin-free regions, 40, of the base (delimited by a dotted lines; 3 present in this instance). Also shown is the opening angle, 44, of a primary fin. Preferably, and in this heat sink, the primary fins extend beyond the base to enhance convection for greater heat dissipation. Thus, the heat sinks shown in FIG. 6 and FIG. 7 (with the primary fins extend beyond the base) are preferred over those of FIG. 8 and FIG. 9 (where the primary fins do not extend beyond the base).

The compound heat sink may be viewed as a plurality of heat sink, with the primary and secondary fins extended out to the edges of a larger circle around the center of the device. Such compound heat sinks may be made for 2, 3, 4, 5, or 6 LEDs. In these compound heat sinks, only a subset of primary fins will have the same size, shape, and straight arms.

Figure 8:
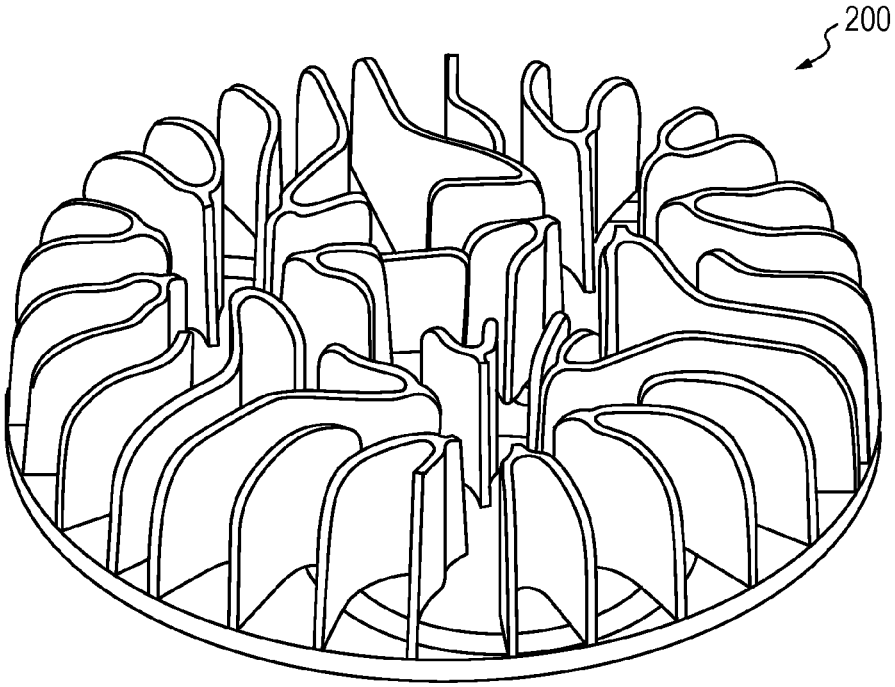
FIG. 8 illustrates a perspective view of a third heat sink.

FIG. 8 illustrates a perspective view of a third heat sink, 200. This is a compound heat sink, intended for use with a plurality of LEDs (in this instance, 3 LEDs), used in a single high bay LED device. The compound heat sink includes 18 primary fins, 20, 9 secondary fins, 22, a base, 24, 7 base convection holes, 26, and primary fin convection holes, 30, in many of the primary fins.

Figure 9:
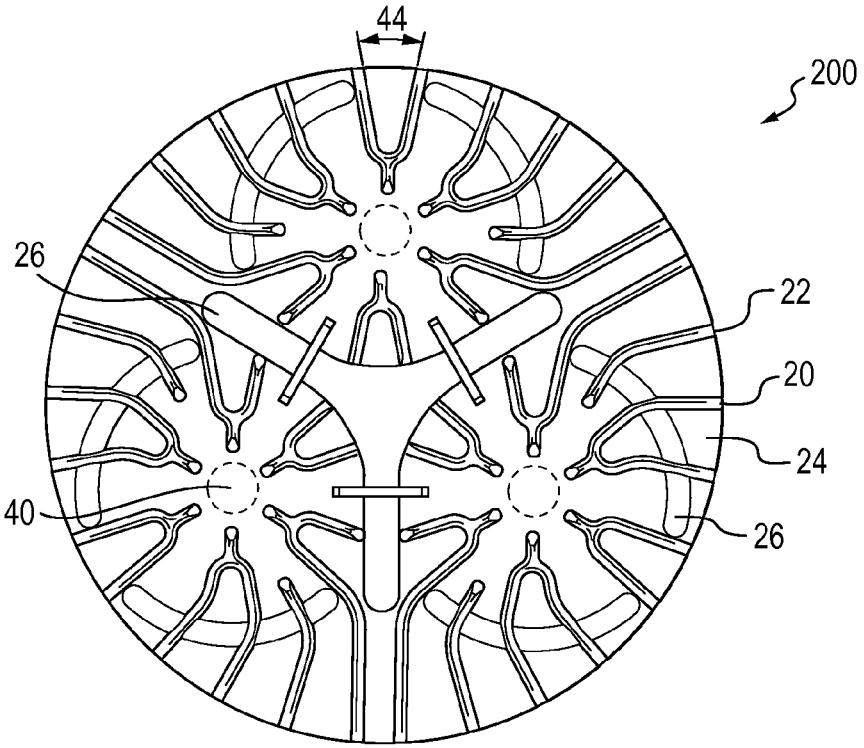
FIG. 9 illustrates a top view of the third heat sink.

FIG. 9 illustrates a top view of the third heat sink. In addition to those features illustrated in FIG. 8, this figure also shows fin-free regions, 40, of the base (delimited by a dotted lines; 3 present in this instance). Also shown in the opening angle, 44, of a primary fin. In this heat sink, the primary fins do not extend beyond the base.

EXAMPLES

Example 1

High bay LED devices including a 100 W LED and a heat sink of typical design (which does not include primary fins nor a fin-free region) having a base thickness of 9 mm, with and without a molecular fan coating, were compared to an otherwise identical high bay LED device, using a heat sink of the present application having a base thickness of 8 mm, and having a molecular fan coating. The temperatures of each device near the LED junction were measured, and are illustrated in FIG. 10.

As shown in the figures, although the heat sinks of typical design have almost twice the surface area, the equilibrium temperature was 83° C. for the molecular fan coated heat sink, and 80° C. for the uncoated heat sink. In contrast, the heat sink of the present application coated with a molecular fan had an equilibrium temperature of 71.5° C. The data illustrate that the design of the heat sink has a significant impact on the improvement in heat dissipation which results from a molecular fan coating. In FIG. 10, the heat sink of the present application weighs only 0.86 kg whereas the typical design heat sink weighs 1.57 kg.

Example 2

Figure 11:
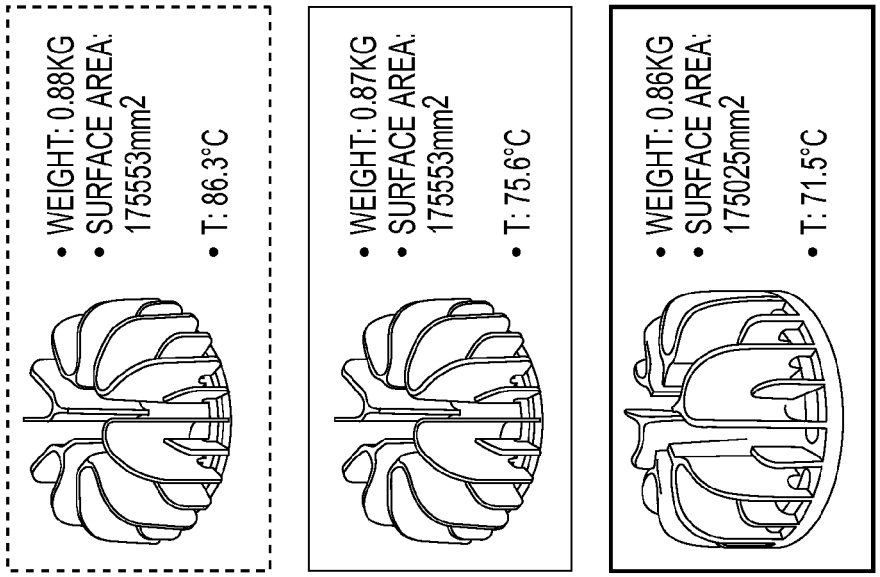
Figure 11:
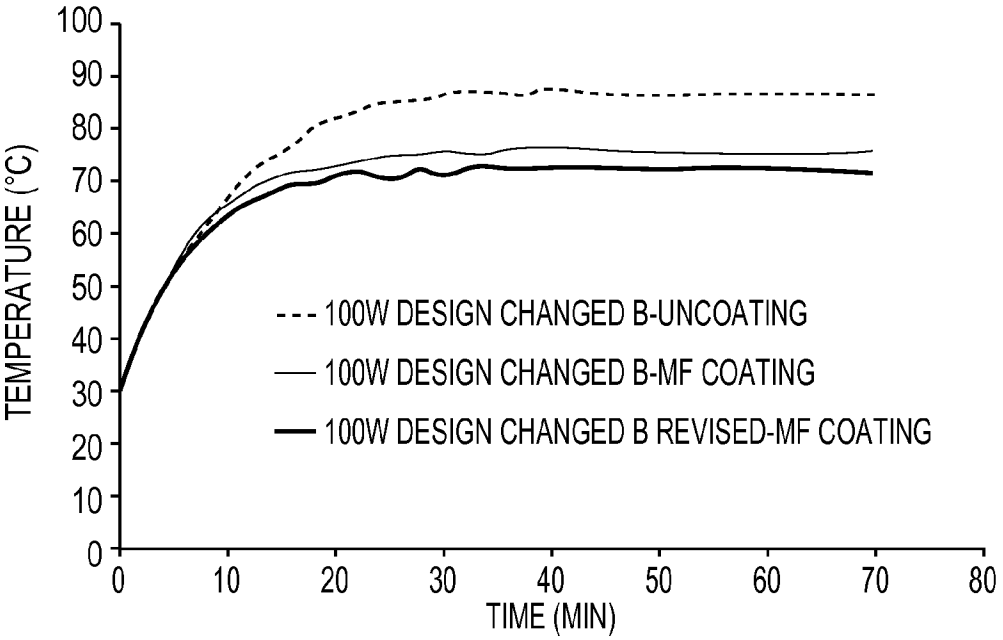

Three high bay LED devices including a 100 W LED and a heat sink of the present application having a base thickness of 8 mm, 10 mm or 11 mm, and having a molecular fan coating, a different molecular fan coating, and no coating were compared. The temperatures of each device near the LED junction were measured, and are illustrated in FIG. 11.

As shown in the figures, the equilibrium temperature for the 8 mm (with molecular fan coating), 10 mm (with a different molecular fan coating) or 11 mm (without a coating) were 71.5° C., 75.6° C. and 86.3° C., respectively. The data in both FIGS. 10 and 11 demonstrate that the heat sink of the present application is not as effective at heat dissipation as those of typical design when the molecular fan coating is absent, but are significantly superior when the molecular fan coating is present.

Example 3

High bay LED devices including three 100 W LEDs and a heat sink of typical design (which does not include primary fins nor a fin-free region), with and without a molecular fan coating, were compared to an otherwise identical high bay LED device, using a heat sink of the present application, and having a molecular fan coating. The temperatures of each device near the LED junctions were measured, and are illustrated in FIG. 12.

As shown in the figures, although the heat sinks of typical design have almost twice the surface area, the equilibrium temperature was 84° C. for the molecular fan coated heat sink, and 82° C. for the uncoated heat sink. In contrast, the heat sink of the present application coated with a molecular fan had an equilibrium temperature of 63.4° C. The data illustrate that the design of the heat sink has a significant impact on the improvement in heat dissipation which results from a molecular fan coating. In FIG. 12, the heat sink of the present application weighs only 3.14 kg whereas the typical design heat sink weighs 4.76 kg.

Example 4

Figure 13:
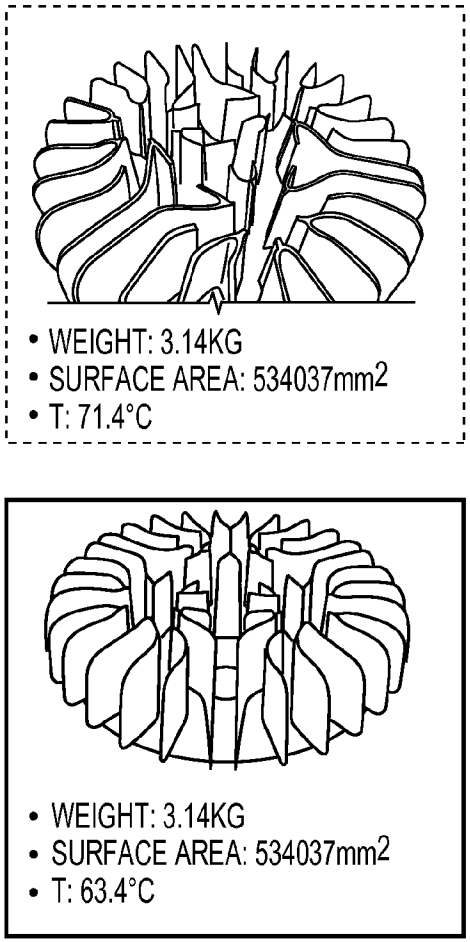
Figure 13:
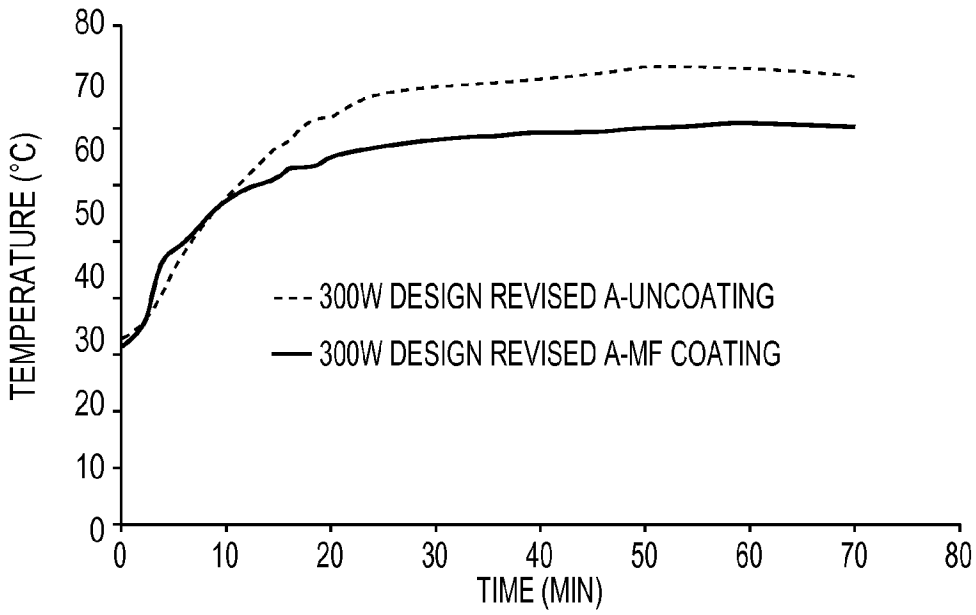

Two high bay LED devices including three 100 W LEDs and a heat sink of the present application, and having a molecular fan coating, and no coating were compared. The temperatures of each device near the LED junctions were measured, and are illustrated in FIG. 13.

The data demonstrate the significant effect that the molecular fan coating has on the heat dissipation of a heat sink of the present application. Commercially available heat sinks (or typical heat sinks) provide "passive" dissipation of heat, and are generally used to achieve an equilibrium temperature for LED devices of about 80° C. or higher. A mechanical fan is needed to remove the excess heat in high power and high brightness LED devices, in addition to a typical heat sink. A molecular fan provides "active" dissipation of heat. Using the heat sinks of the present application, as shown in FIGS. 10-13, with a molecular fan coating lowers the equilibrium temperature to 71.5° C. for a 100 W LED device, and 63.4° C. for a 300 W LED device.

What is claimed is:

1. A heat sink, comprising:
a base,
primary fins, on and vertically extending from the base,
a fin-free region on the base, and
secondary fins, wherein the secondary fins are not in contact with the primary fins,
wherein the primary fins each have
a first arm,
a second arm, which meets the first arm to form a primary fin bottom, and
a stem, which extends away from the primary fin bottom, and
wherein:
the heat sink comprises 4 to 8 primary fins,
the primary fins each have an opening angle of 22.5° to 45° , and
the primary fins are disposed radially around the fin-free region, with the stem of each primary fin oriented toward the fin-free region.

2. The heat sink of claim 1, wherein the secondary fins each have a height of ¼ to ¾ of a height of the primary fins.

3. The heat sink of claim 2, wherein the secondary fins are disposed radially around the fin-free region.

4. The heat sink of claim 3, wherein the base, the primary fins and the secondary fins, form a monolithic structure.

5. The heat sink of claim 3, further comprising:
convection holes, in the base, and
a convection hole, in each arm of the primary fins,
wherein each convection hole in each arm of the primary fins is contiguous with a convection hole in the base.

6. The heat sink of claim 5, further comprising a molecular fan coating.

7. A high bay LED device, comprising:
an LED,
the heat sink of claim 1, thermally coupled to the LED,
a lens, surrounding the LED, and
a reflector, surrounding the lens,
wherein the fin-free region of the base is located directly above the LED.

8. A method of producing light, comprising applying an electric current to the high bay LED device of claim 7.

9. A compound heat sink, comprising:
a base,
primary fins, on and vertically extending from the base,
a plurality of fin-free regions, on the base, and
secondary fins, wherein the secondary fins are not in contact with the primary fins,
wherein the primary fins each have
a first arm,
a second arm, which meets the first arm to form a primary fin bottom, and
a stem, which extends away from the primary fin bottom, and
at least one of the primary fins has an opening angle of 22.5° to 45° , and the primary fins are disposed around the fin-free regions, with the stem of each primary fin oriented toward one of the fin-free regions.

10. The heat sink of claim 9, wherein the base, the primary fins, and the secondary fins, form a monolithic structure.

11. The heat sink of claim 9, further comprising a convection hole, in the base.

12. The heat sink of claim 9, further comprising a molecular fan coating.

13. The heat sink of claim 11, further comprising a molecular fan coating.

14. The heat sink of claim 13, wherein:
the heat sink has 18 primary fins,
the heat sink has 9 secondary fins,
the heat sink comprises 7 base convection holes, and
at least 3 of the primary fins have an opening angle of 22.5° to 45°.

15. A high bay LED device, comprising:
a plurality LEDs,
the heat sink of claim 11, thermally coupled to the LEDs,
a lens, surrounding the LEDs, and
a reflector, surrounding the lens,
wherein the fin-free regions of the base are located directly above each LED.

16. A method of producing light, comprising applying an electric current to the high bay LED device of claim 15.

17. A heat sink, comprising:
a base,
primary fins, on and vertically extending from the base,
a fin-free region on the base,
a molecular fan coating, and
secondary fins, wherein the secondary fins are not in contact with the primary fins,
wherein the primary fins each have
a first arm,
a second arm, which meets the first arm to form a primary fin bottom, and
a stem, which extends away from the primary fin bottom,
the first arm and the second arm are not parallel, and the primary fins each have an opening angle of at least 22.5°.

18. The heat sink of 17, wherein at least one of the primary fins has an opening angle of 22.5° to 45°.

* * * * *